United States Patent [19]

Murman

[11] 4,098,516

[45] Jul. 4, 1978

[54] BLOWOUT PREVENTER PACKING UNIT WITH SLANTED REINFORCING INSERTS

[75] Inventor: Fernando Murman, Rancho Palos Verdes, Calif.

[73] Assignee: Hydril Company, Los Angeles, Calif.

[21] Appl. No.: 824,748

[22] Filed: Aug. 15, 1977

[51] Int. Cl.[2] ..... B65D 53/00; E21B 33/12

[52] U.S. Cl. ..... 277/235 R; 277/73; 251/1 B

[58] Field of Search ..... 251/1 R, 1 B; 92/241; 277/9.5, 73, 126, 129, 235 R

[56] References Cited

U.S. PATENT DOCUMENTS

| | | | |
|---|---|---|---|
| 2,609,836 | 9/1952 | Knox | 277/73 |
| 3,572,627 | 3/1971 | Jones | 251/1 B |
| 3,591,125 | 7/1971 | Lewis | 251/1 B |

*Primary Examiner*—Robert S. Ward, Jr.
*Attorney, Agent, or Firm*—William W. Haefliger

[57] ABSTRACT

An annular blowout preventer packing unit having a longitudinal axis incorporates metallic inserts having webs that extend both longitudinally and about that axis to define surfaces which have longitudinally facing extents to anchor and resist longitudinal displacement of packer elastomeric material. The webs may typically have upper and lower portions with oppositely directed curvatures, respectively.

27 Claims, 25 Drawing Figures

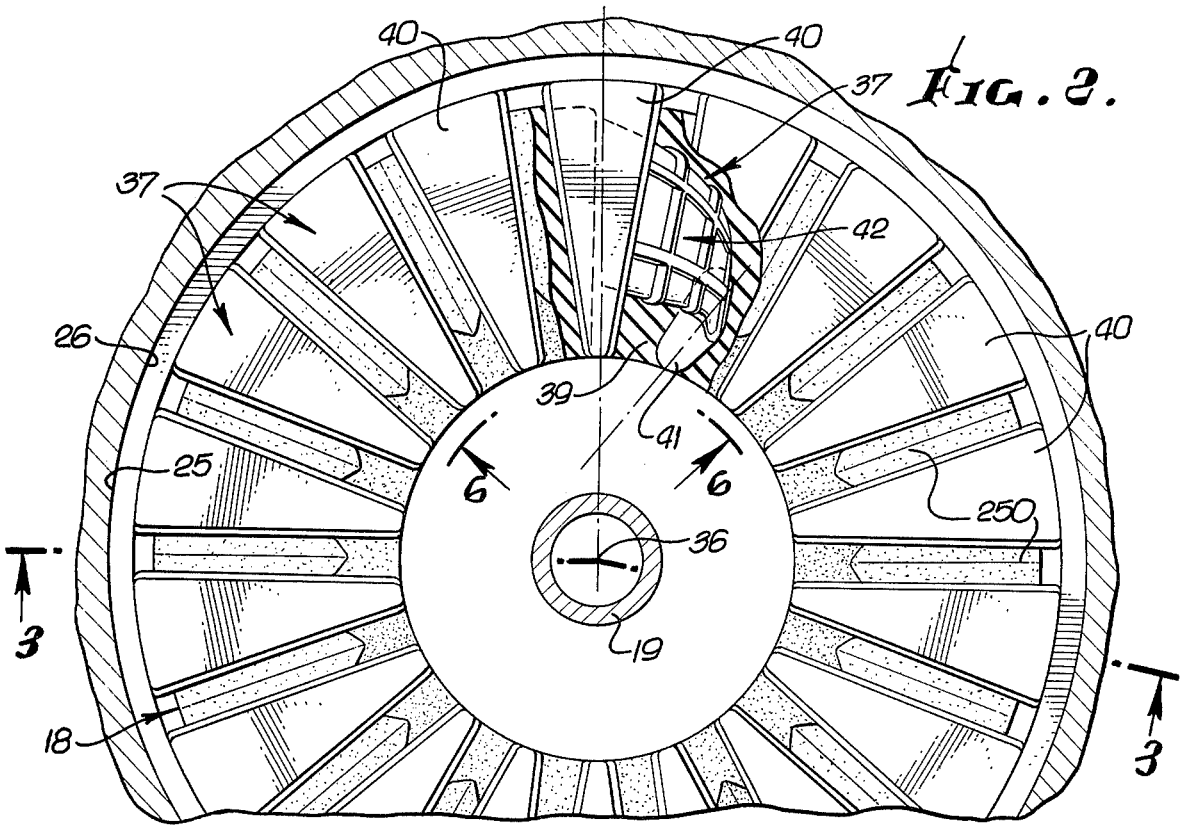
FIG. 2.
FIG. 3.
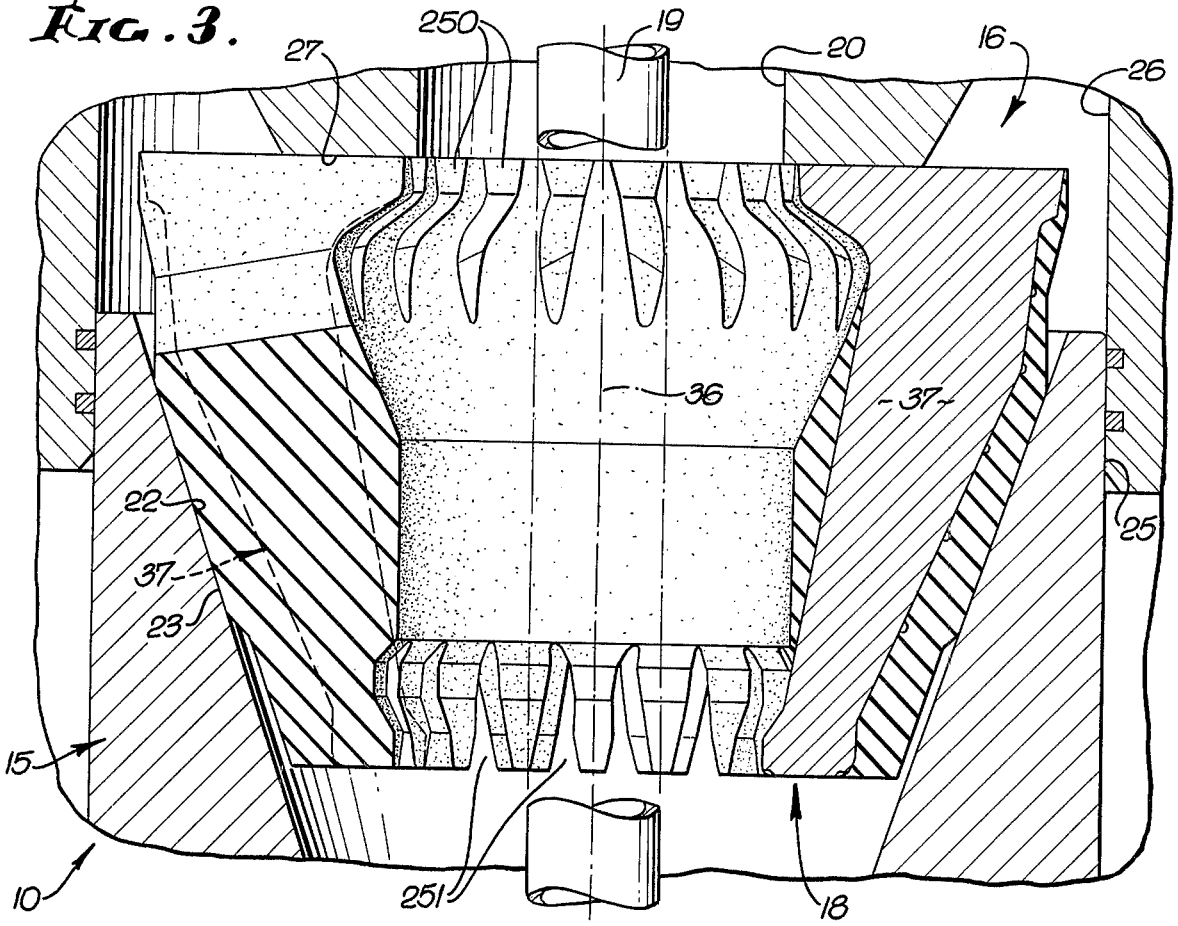

BLOWOUT PREVENTER PACKING UNIT WITH SLANTED REINFORCING INSERTS

BACKGROUND OF THE INVENTION

This invention relates generally to well blowout preventers, and more particularly concerns packer units and inserts used in such equipment.

U.S. Pat. No. 2,609,836 to Knox describes annular type blowout preventer packing units which incorporate like metal inserts spaced about the packer central axis, and embedded by an elastomeric, such as rubber, body. Upon inward constriction of the unit about a well drill pipe, or upon itself, the rubber is squeezed radially inwardly with resistance imposed by the inserts to which the rubber is anchored. Well pressure exerted upwardly upon the stretched or extended rubber also tends to displace it upwardly, so that the material is subjected to strain both radially and vertically. This causes fatigue and weakening of the material, particularly after repeated closure of the preventer unit, so that each unit is normally rated as to its capability to safely sustain or withstand a certain number of closures. Efforts have been made to increase this number of closures, but the problem of extreme stretching of the rubber has limited the success of such efforts.

SUMMARY OF THE INVENTION

It is a major object of the invention to provide an improved blowout preventer unit characterized in that the capability of the metal inserts to effectively anchor the rubber under extreme well pressure is substantially enhanced, with the result that stretching of the rubber is substantially reduced, and with the result that the life of the preventer unit is materially enhanced.

Basically, the packing unit of the invention employs improved metallic inserts having webs that extend both longitudinally and laterally in directions about the packer axis, to define surfaces which have longitudinally axially facing extent. The webs may be regarded as extending generally helically, and such surfaces act effectively to retain or anchor the elastomeric material against longitudinal displacement, particularly as the packer is closed about well pipe, or to seal off open hole, as will be seen; on the other hand, such surfaces do not inhibit required radially inward displacement or extrusion of the rubber material for well seal off purposes.

As will be seen, the insert webs typically include upper and lower portions with oppositely directed curvatures, and joined at a zone of inflection; and the upper portion may be concave in one direction about the packer axis, and the lower portion convex in that direction. Further, the insert includes upper and lower end plates, the lower plate offset relative to the upper in a direction about the packer axis, and the web upper and lower portions are elongated toward an inner region associated with the unit axis. In one form of the invention, such portions are laterally parallel, whereas in another form such portions have lateral skew angularity, relative to one another, as will be described. As a result of the foregoing, the webs, become nested when the packer is constricted, so that the packer material between the webs is more effectively anchored or captured, assuming the curvature of the webs themselves. In addition, ribbing on the webs enhances this effect. Consequently, the rubber is subjected to materially less stretching and strain, particularly in an axial direction, and the life of the preventer is enhanced.

These and other objects and advantages of the invention, as well as the details of illustrative embodiments, will be more fully understood from the following description and drawings, in which:

DRAWING DESCRIPTION

FIG. 2 is an enlarged plan view, partly broken away, on lines 2—2 of FIG. 1;

FIG. 3 is a section, taken in elevation, on lines 3—3 of FIG. 2;

DETAILED DESCRIPTION

Figure 1:
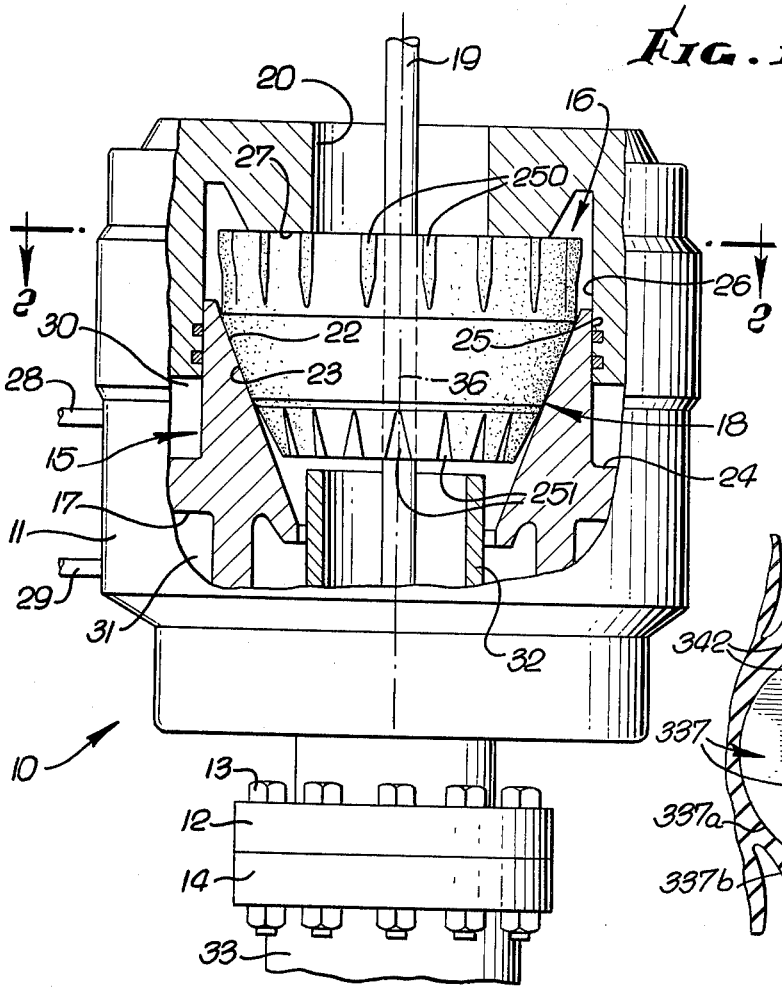
FIG. 1 is a front elevation, partly in section, showing a packer incorporating the invention installed in blowout prevention apparatus.
Figure 25:
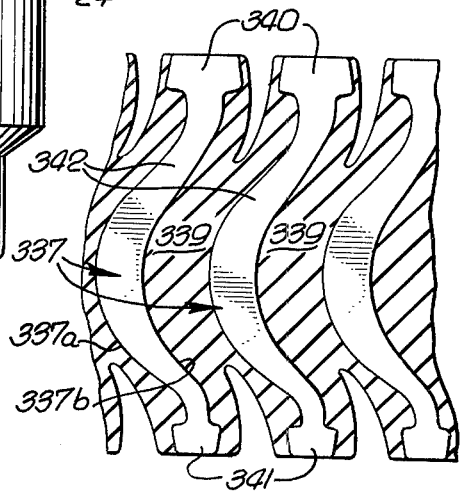
FIG. 25 is like FIG. 6, but shows an alternate configuration.

Referring to FIGS. 1 and 3, a blowout preventer 10 includes a metallic housing 11, the lowermost extent of which is flanged at 12 and bolted at 13 to well head casing flange 14 or other well head equipment. The housing contains a piston 15 movable upwardly in chamber 16 in response to fluid pressure exertion upwardly against piston face 17, for constricting an annular packer unit 18 via pressure exertion from piston cam surface 22 against packer exterior surface 23. Surfaces 22 and 23 are frusto-conical and flared upwardly. The packer when sufficiently radially inwardly displaced, seals off about a well pipe 19 shown extending axially vertically through the preventer 10; and in the absence of the pipe, the packer unit 18 will completely close off the vertical passage 20 through the preventer, when the unit is sufficiently constricted by piston 15. Upon downward movement of the piston in response to fluid pressure exertion against face 24, the packer expands radially outwardly to the open position seen in FIGS. 1 and 2. Note that the piston annular surface 25 may have guided sliding engagement with housing cap bore 26, and that the packer unit is normally confined vertically under the housing cap lower interior surface 27. Fluid pressure lines 28 and 29 communicate external pressure to chambers 30 and 31, respectively. Vertical sleeve 32 communicates with the well via the casing 33, and the top of the sleeve seats the packer when the piston 15 is in down position.

Figure 6:
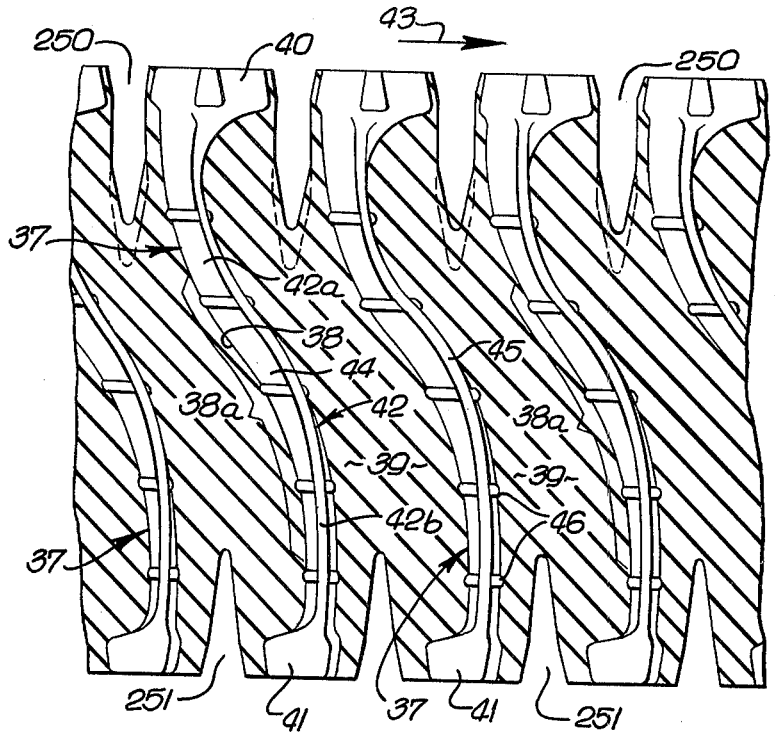
FIG. 6 is a fragmentary, linearly developed, elevation taken on lines 6—6 of FIG. 2.
Figure 4:
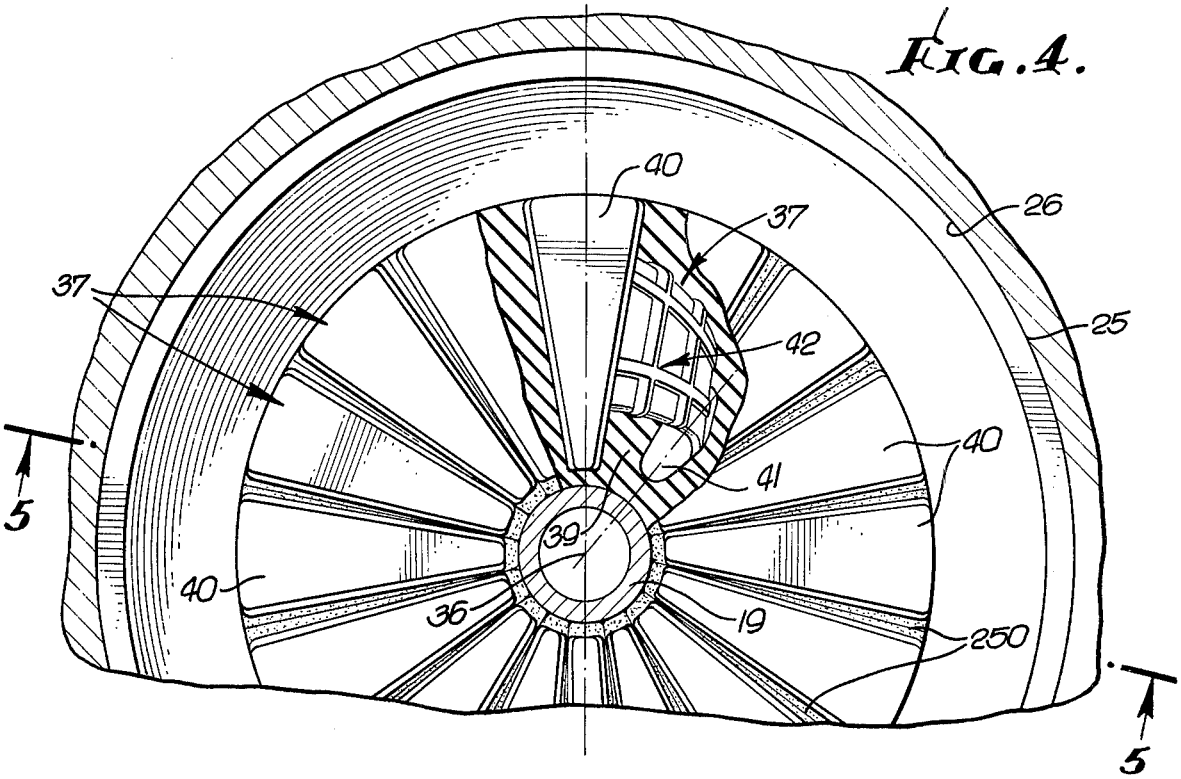
FIG. 4 is a view like FIG. 2, but showing the packer closed about well pipe.
Figure 5:
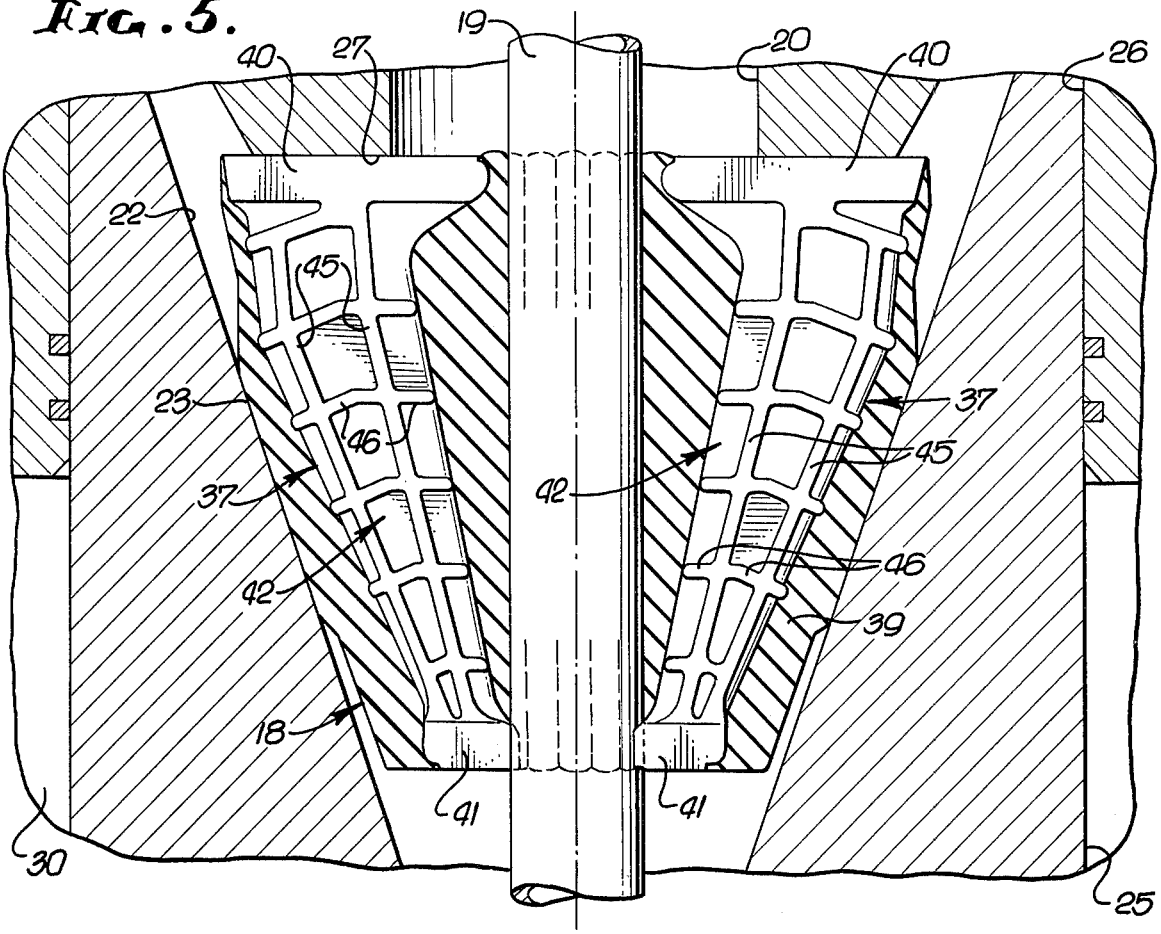
FIG. 5 is an elevation taken in section on lines 5—5 of FIG. 4.

In accordance with the invention, the packer unit 18 has a longitudinal upright axis 36 toward which the unit is adapted to be constricted or compressively displaced, radially inwardly. Basically, the unit comprises:

(a) metallic inserts, as for example at 37, generally circularly spaced about axis 36, the inserts having webs that extend longitudinally and in directions about the axis 36 (as for example helically) to define surfaces (as at 38) which have longitudinally facing extents 38*a*, and (b) an annulus of elastomeric material 39 extending about axis 36 and embedding the webs; also, the material 39 extends in contacting relations with the surface extents 38*a* (as seen in FIG. 6, for example) so that the webs anchor the material and resist upward longitudinal displacement of the material, under extreme well pressure exertion on the packer during compressive displacement of the packer, as seen in FIGS. 4 and 5, for example.

More specifically, the inserts 37 shown in FIGS. 1–14 are alike and have upper and lower end plates 40 and 41 between which the webs 42 extend. The webs have upper portions 42*a* and lower portions 42*b* with oppositely directed curvature; for example, the upper portions 42*a* in FIG. 6 are concave in one circular direction (indicated by arrow 43) about axis 36, and lower portions 42*b* are convex in that direction. Further, there is a region of inflection at 44 between such oppositely curved upper and lower portions. In addition, the lower plate 41 is offset relative to the upper plate 40, and in the direction 43 about axis 36.

As is clear from FIGS. 5 and 6, the webs may have upright ribbing 45 extending therealong and lateral ribbing 46 extending thereabout, such lateral ribbing protruding so as to provide additional surfaces to anchor the rubber material 39 against longitudinal displacement under extreme overall pressure. The longitudinal ribbing 45, which has the described curvature of the webs, anchors rubber material against excessive flow radially inwardly during radial constriction of the packer. Such constriction results in relative nesting of successive of the curved webs, whereby the lower portion 42*b* of each web extends beneath the upper portion 42*a* of a next successive web, with the result that rubber or elastomeric packer material between the nested webs is better retained or anchored against upward displacement than in prior packers where the webs remained vertical and parallel. The FIG. 6 webs 42 move closer together, when nested.

Turning to FIGS. 7–10, it will be seen that the upper and lower web portions 42*a* and 42*b* are laterally elongated in generally parallel directions toward an inner region about axis 36, which region does not necessarily coincide with axis 36 but is proximate thereto. This is further seen in FIG. 10 wherein horizontal web sections are schematically depicted at 50, 51, 52 and 53. Sections 50 and 51 are taken at different elevations in upper portion 42*a* of the web 42, and sections 52 and 53 at different elevations in the lower section 42*b* of the web. Sections 50–53 are wedge shaped, and have parallel central axes 50*a* –53*a*. The bottom plate or foot 41 is skewed relative to the top plate and sections 50–53, are directed in such relation that when the packer is closed about pipe 19, or upon itself (in this case of open hole), the axis 41*a* of wedge-shaped plate 41 will be directed toward or close to axis 36.

Figure 7:
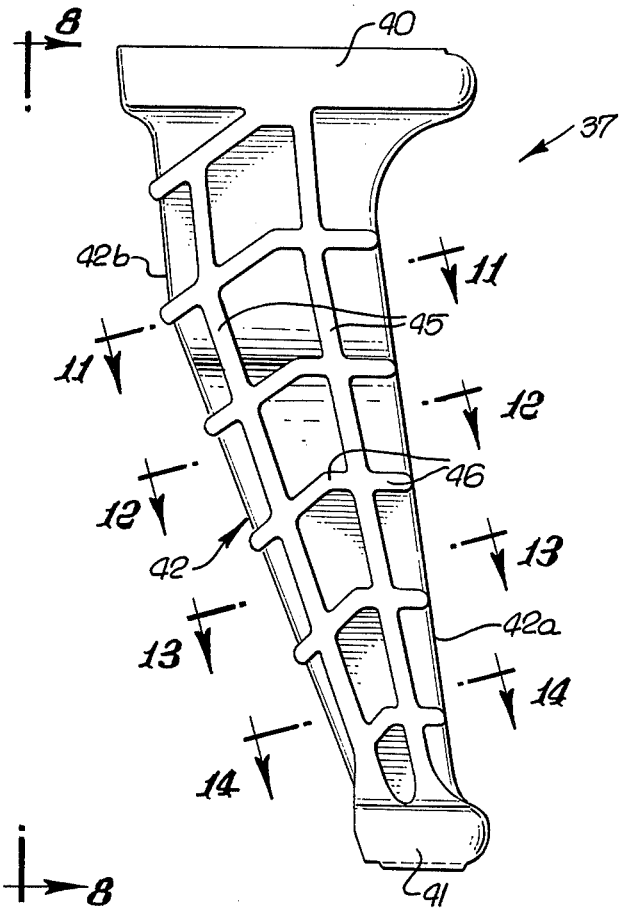
FIG. 7 is a side elevation of a metallic insert as used in the packer of FIGS. 1-6.
Figure 8:
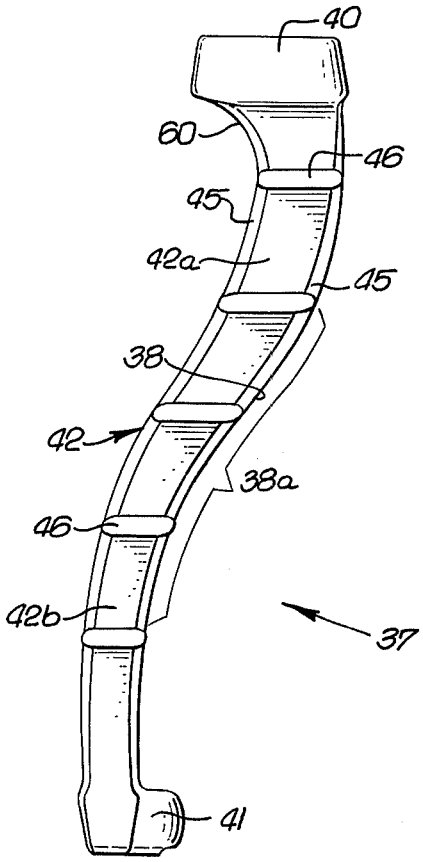
FIG. 8 is an end elevation taken on lines 8—8 of FIG. 7.
Figure 10:
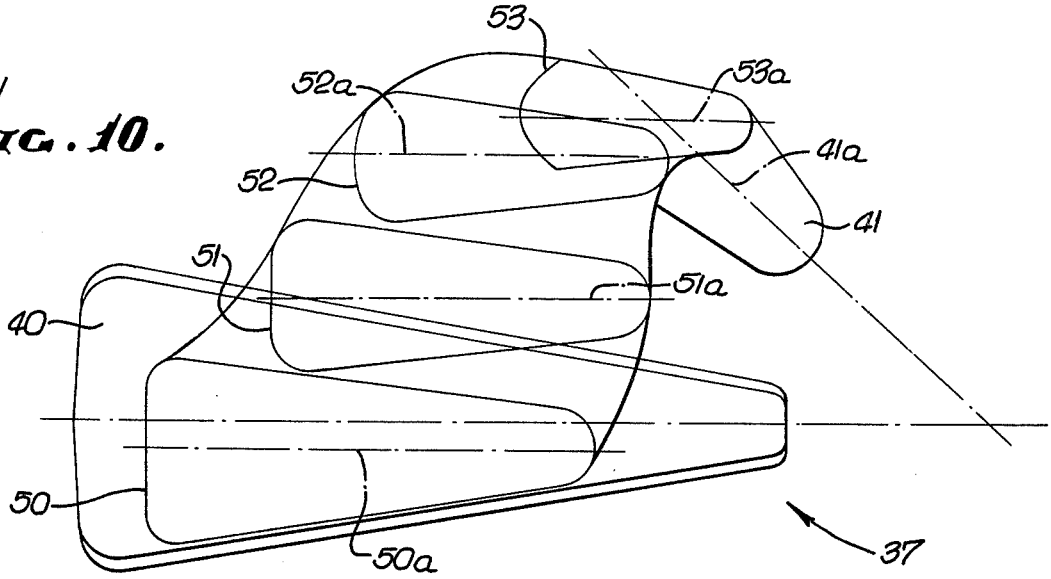
FIG. 10 is a schematic view like FIG. 9, but showing the directional orientation of various horizontal sections.
Figure 9:
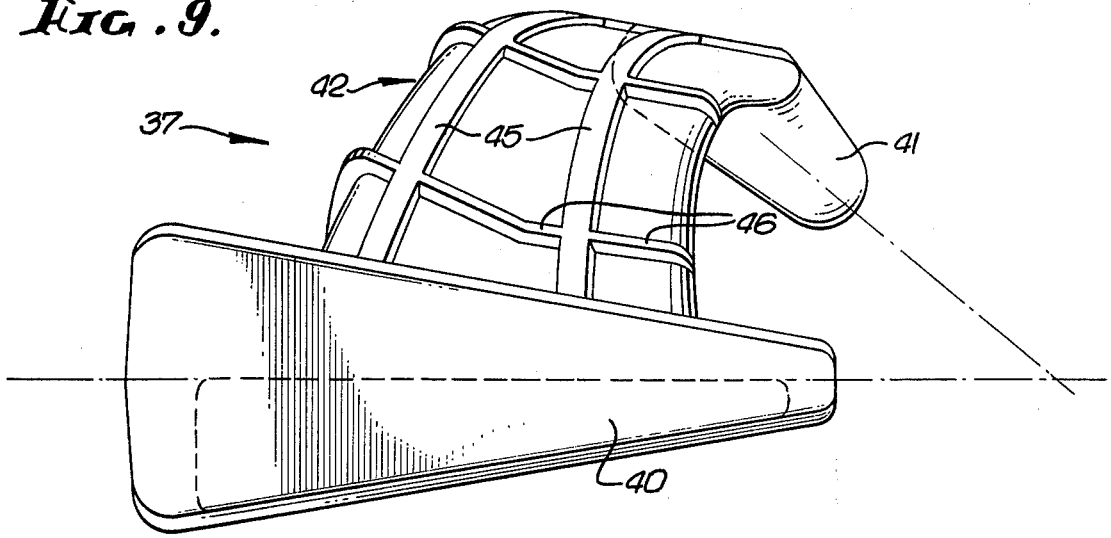
FIG. 9 is a top plan view of the insert of FIG. 7.
Figure 11:
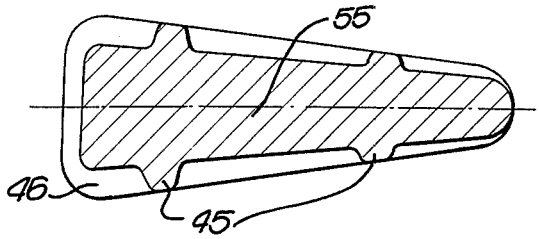
FIGS. 11-14 are sections on lines 11—11 to 14—14 of FIG. 7.
Figure 12:
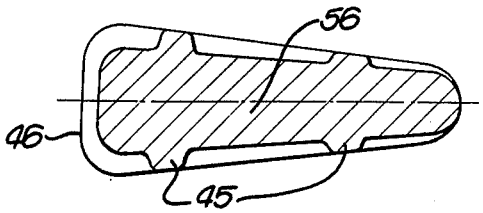
Figure 13:
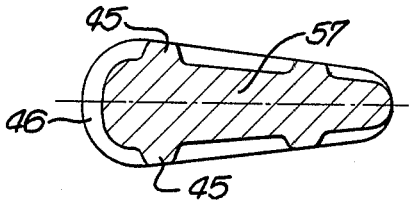
Figure 14:
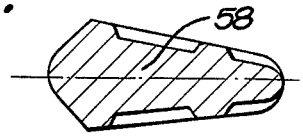
Figure 15:
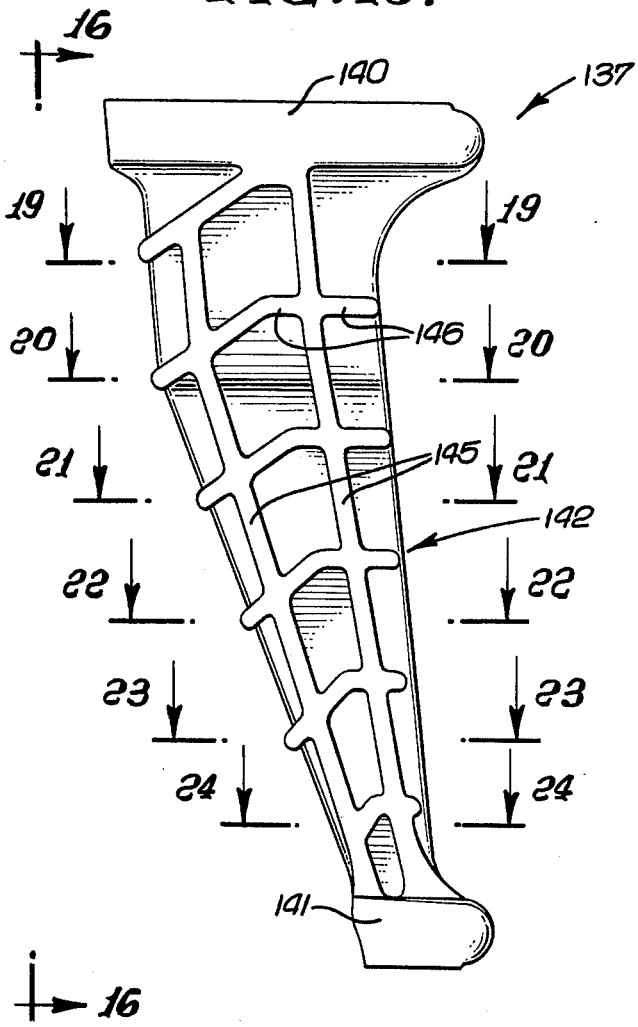
FIG. 15 is a view like FIG. 7 but showing a modified insert construction.
Figure 16:
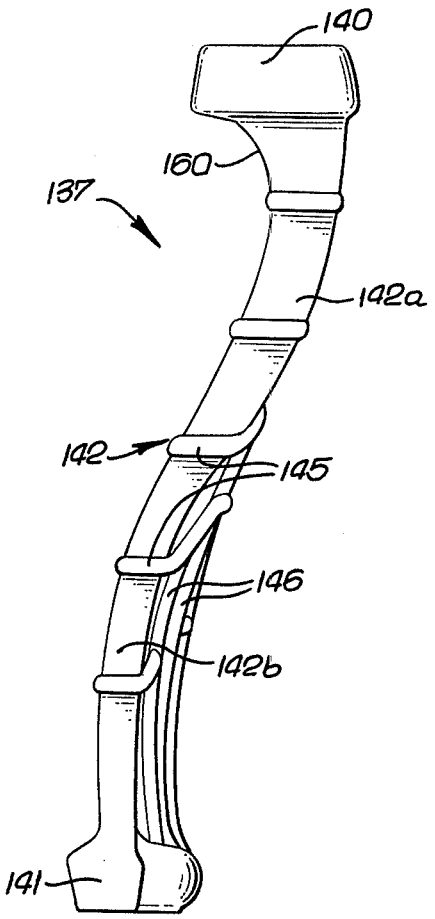
FIG. 16 is an end view of the FIG. 15 insert taken on lines 16—16.
Figure 18:
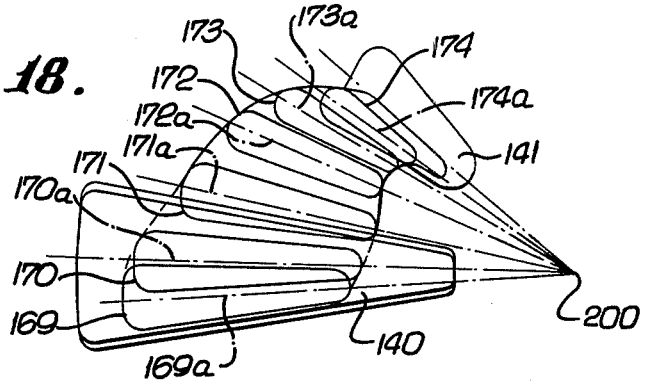
FIG. 18 is a schematic view, like FIG. 17, of the FIG. 15 insert but showing the directional orientations of horizontal sections.
Figure 17:
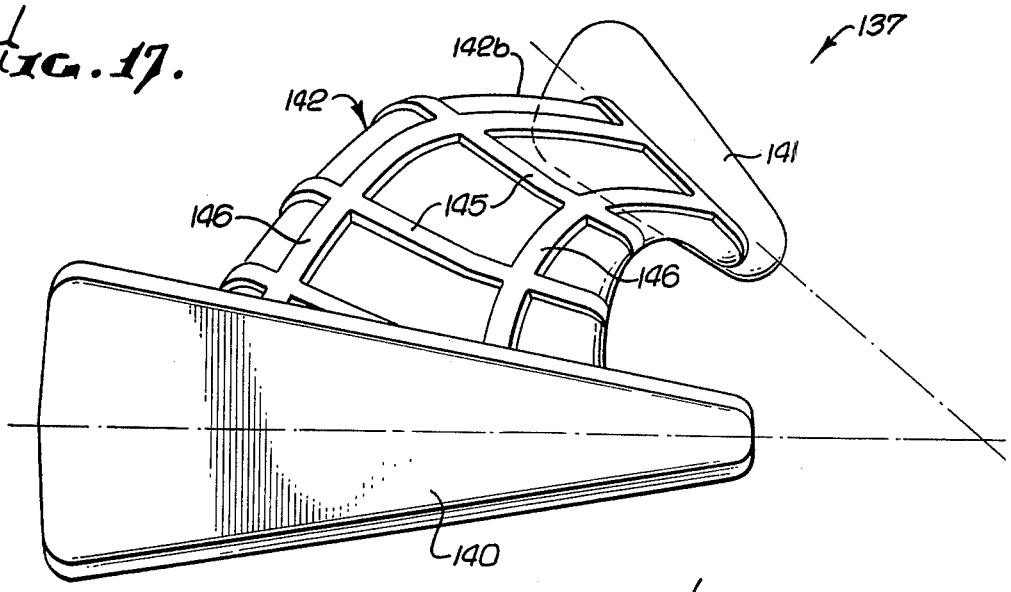
FIG. 17 is a top plan view of the FIG. 15 insert.
Figure 19:
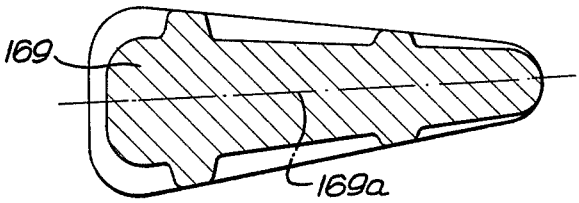
FIGS. 19-24 are sections taken on lines 19—19 to 24—24 of FIG. 15.
Figure 20:
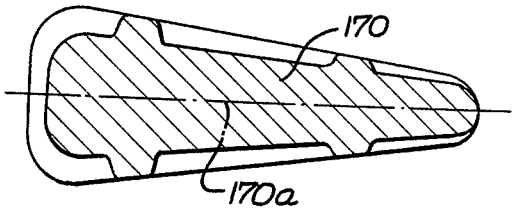
Figure 21:
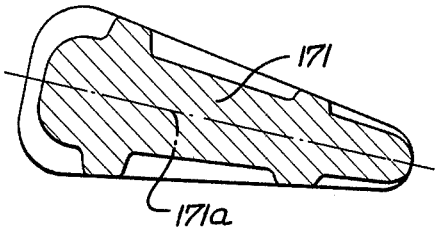
Figure 22:
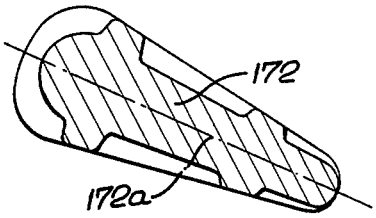
Figure 23:
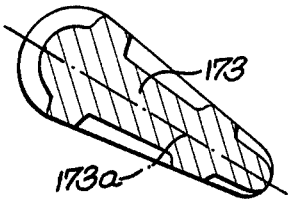
Figure 24:
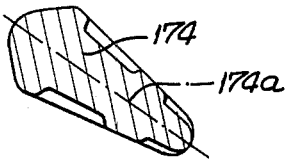

Note also the lateral sections seen in FIGS. 11–14, and which are parallel and in planes offset slightly from horizontal. Such wedge shaped sections have axes 55–58 which are parallel; sections 11 and 12 associated with web upper portion 42*a* and sections 13 and 14 associated with web lower portion 42*b*. FIG. 7 also shows that the lower plate 41 is offset inwardly relative to upper plate 40. FIG. 8 shows that the upper portion 42*a* provides an additional curved surface extent 60 wherein faces longitudinally downwardly to anchor rubber packer material therebeneath. Surface extent 60 is at the side of the web opposite from surface extent 38*a* previously described, and also facing downwardly.

The modified insert shown in FIGS. 15–24 bears certain numerals which correspond to those applied to the insert 37, a hundred digit numeral "1" being added. The modified insert 137 has the same characteristics as those described for insert 37, with the following exceptions: in FIGS. 15 and 18–24 the horizontal sections 169–174 taken along and through web 142 are progressively skewed, i.e. have increasing skew angularity along their axial lengths, as are defined for example by axes 169*a*–174*a*. Such axes have extension which meet at points along a common longitudinal axis 200 parallel to packer axis 136. Axis 200 may coincide with axis 136 for some position of the packer, as for example unconstricted, partially constricted, or fully constricted. Sections 169–171 are associated with the upper portion 142*a* of the web 142, and sections 172–174 associated with the lower portion 142*b* of the web.

Lower plate or foot 141 is also laterally elongated toward axis 200, despite the fact that it is offset from top plate 140 as seen in plan view 18. Such offsetting is both circular (relative to axes 136 and 200), and lateral or radial. Top plate 140 also is elongated toward axis 200.

Referring back to FIGS. 1–3, the packer material is seen to define radial slots or gaps 250 and 251 at the top and bottom of the unit, such slot being subject to narrowing as the packer constricts. The slots are circularly spaced and located between the top and bottom plates of adjacent inserts.

Finally, FIG. 6 shows an alternate configuration of inserts 337, with upper and lower end plates 340 and 341 located and centered vertically above one another. The inserts have webs 342 which are bowed laterally, as shown, out of vertical alignment with plates 340 and 341. The webs may be curved, as shown, to define surfaces having longitudinally facing extents to resist longitudinal (i.e. vertical) displacement of packer material 339 embedding the webs. Note web convex and concave lateral surfaces 337*a* and 337*b*. This double convolution configuration possesses the advantages described above, and also allows use of packer molding tooling previously employed for packers wherein the insert top and bottom plates were spaced one above the other.

I claim:

1. In an annular blowout preventer packing unit having a longitudinal axis, the packing unit adapted to be compressively displaced inwardly toward said axis the improvement combination comprising (a) metallic inserts generally circularly spaced about said axis, the inserts having webs that extend both longitudinally and in directions about said axis to define surfaces which have longitudinally facing extents, (b) an annulus of elastomeric material extending about said axis and embedding said webs, the material extending in contacting relation with said surface extents so that the webs anchor the material and resist longitudinal displacement thereof during said compressive displacement of the packer.

2. The improvement combination of claim 1 wherein certain of said webs have upper and lower portions with oppositely directed curvatures, respectively.

3. The improvement combination of claim 1 wherein each of said webs has an upper portion which is concave in one direction about said axis and a lower portion which is convex in said direction.

4. The improvement combination of claim 1 wherein each of said webs has upper and lower portions, there being a region of inflection between said upper and lower portions.

5. The improvement combination of claim 1 wherein each insert has an upper plate and a lower plate, the lower plate offset relative to the upper plate, and in direction about said axis.

6. The improvement combination of claim 4 wherein each insert has an upper plate and a lower plate between which said upper and lower web portions with different angularities are located, the lower plate offset relative to the upper plate, and in a direction about said axis.

7. The improvement combination of claim 5 wherein the web portions are elongated generally radially toward said axis.

8. The improvement combination of claim 6 wherein the web portions are laterally elongated toward an inner region about said axis, said portions being further characterized by increasing skew angularity along the axial lengths thereof.

9. The improvement combination of claim 6 wherein the web portions are generally laterally elongated, and in generally parallel directions.

10. The improvement combination of claim 1 wherein successive of said webs have nested relationship when the packer is displaced radially inwardly.

11. The improvement combination of claim 6 wherein successive of said webs have nested relationship when the packer is displaced radially inwardly.

12. The improvement combination of claim 6 wherein the upper plate is elongated in a first direction toward said axis, and the lower plate is elongated in a second direction toward an inner region about said axis, said second direction angularly skewed, relative to said first direction.

13. The improvement combination of claim 12 wherein said inserts are inwardly displaced when the packer is compressively displaced inwardly.

14. The improvement combination of claim 13 wherein said lower plates, when displaced inwardly, have positions wherein they are elongated generally toward said axis.

15. The improvement combination of claim 6 wherein said elastomeric material forms inwardly protruding folds when the packer is compressively displaced radially inwardly, said folds having angularity which corresponds to that of said web upper and lower portions.

16. Metallic inserts usable in an annular blowout preventer packer unit having a longitudinal axis the packer unit comprising an elastomeric body carrying the inserts and adapted to be compressively displaced inwardly toward said axis, each of said inserts comprising (a) top and bottom ends and a web extending therebetween, (b) said web extending both longitudinally and in a direction about said axis to define surfaces to receive generally axial loading transmitted by the body during said compressive displacement.

17. The insert of claim 16 wherein said web has upper and lower portions with oppositely directed curvatures, respectively.

18. The insert of claim 16 wherein said web has an upper portion which is concave in one direction about said axis, and a lower portion which is convex in said direction.

19. The insert of claim 16 wherein the web has upper and lower portions with different curvatures, respectively, there being a region of inflection between said upper and lower portions.

20. The improvement combination of claim 15 wherein the insert has an upper plate and a lower plate, the lower plate offset relative to the upper plate, and in a direction about said axis.

21. The improvement combination of claim 19 wherein the insert has an upper plate and a lower plate between which said upper and lower web portions with different curvatures are located, the lower plate offset relative to the upper plate, and in a direction about said axis.

22. The improvement combination of claim 20 wherein the web portions are elongated generally radially toward said axis.

23. The improvement combination of claim 21 wherein the web portions are elongated toward an inner region about said axis, said portions being further characterized by increasing skew angularity along the axial lengths thereof.

24. The improvement combination of claim 21 wherein the upper plate is elongated in a first direction toward said axis, and the lower plate is elongated in a second direction toward an inner region about said axis, said second direction angularly skewed, relative to said first direction.

25. The improvement combination of claim 22 wherein the web portions are generally laterally elongated, and in generally parallel relation.

26. The improvement combination of claim 1 wherein each insert has an upper plate and a lower plate between which a web extends, the web locally protruding sidewardly in a direction about said axis.

27. The improvement combination of claim 26 wherein the protruding web bulges sidewardly, the upper and lower plates generally vertically aligned.

* * * * *